2/3/81 XR 4,248,313

United States Patent [19]

Bonca

[11] 4,248,313

[45] Feb. 3, 1981

[54] EARTH BORING AUGER

[76] Inventor: Aaron Bonca, 17 Sedgemount Dr., Scarborough, Ontario, Canada, M1H 1X2

[21] Appl. No.: 62,919

[22] Filed: Aug. 2, 1979

[51] Int. Cl.[3] ..... E21B 25/02

[52] U.S. Cl. ..... 175/239; 175/394; 175/50; 175/246; 175/403; 73/84

[58] Field of Search ..... 175/50, 236, 239, 246, 175/247, 248, 317, 318, 394, 403; 73/84, 85

[56] References Cited

U.S. PATENT DOCUMENTS

| | | | |
|---|---|---|---|
| 632,764 | 8/1899 | Stephens | 175/403 |
| 1,209,058 | 12/1916 | Smith | 175/394 |
| 2,162,578 | 6/1939 | Hacker | 175/318 X |
| 2,894,722 | 7/1959 | Buttolph | 175/317 X |
| 3,095,051 | 6/1963 | Robinsky et al. | 175/248 X |
| 3,136,376 | 6/1964 | Robinsky | 175/238 X |
| 3,709,031 | 1/1973 | Wilson et al. | 73/84 X |

*Primary Examiner*—James A. Leppink
*Assistant Examiner*—Richard E. Favreau
*Attorney, Agent, or Firm*—Ridout & Maybee

[57] ABSTRACT

In a hollow stem auger for earth boring of the kind having spring loaded valve members at the bottom of the stem to permit the passage of test implements such as corers and vane test implements, the auger bit is constructed with a cage formation enclosing the valve member and supporting a bottom ring carrying cutting teeth. Interference of the valve members with a test implement is prevented by using an uncoupleable cylindrical sleeve surrounding the implement which sleeve can be lodged between the valve members to hold them open during use of the implement.

7 Claims, 7 Drawing Figures

EARTH BORING AUGER

FIELD OF THE INVENTION

This invention relates to augers intended for earth boring, of the kind having hollow stems to facilitate the recovery of samples or the making of tests during boring.

BACKGROUND OF THE INVENTION AND PRIOR ART STATEMENT

When recovering samples using hollow stem augers, the normal procedure has been to remove a closure at the bottom of the hollow stem using a string of rods which are then withdrawn and used to lower a sampling tube or testing tool to the now open bottom of the stem. The tool is then withdrawn again and the closure replaced, again using the string of rods. Particularly with a deep bore, this procedure is extremely laborious and time consuming, and may require to be repeated at quite frequent intervals.

For this reason proposals have been made to provide closure means at the bottom of the stem which can remain in situ during sampling and testing operations. Examples of such proposals are contained in U.S. Pat. No. 3,095,051 issued June 25, 1963 to Robinsky et al, and Canadian Pat. No. 711,139 issued June 8, 1965 to Robinsky. In the first of these patents, the bottom of the auger tube is closed by a valve formed by two spring leaves extending from the bottom of the tube in a cusp-like formation. A sampling tube can be thrust between the valve members formed by these leaves so as to penetrate the soil beneath, and the leaves will spring back into place so as to close the auger stem when the tube is withdrawn. In the second patent, the bottom of the tube is closed by shaped rigid hinged valve members spring urged towards a closed condition. These members also are arranged to be thrust apart by a sampling tube.

With these arrangements it is necessary for the flights of the auger to project forwardly of the spring or valve members, which reduces the support available to the forward portions of the flights and weakens the structure of the auger. Moreover the spring or other valve members are somewhat vulnerable to damage. The valve arrangement increases the cost of the auger, thus providing a substantial financial burden if a range of augers are required to suit different soil conditions, or if frequent repair or replacement is required. It is known to provide earth boring augers with detachable teeth at their leading ends which can be exchanged or replaced as necessary, but these teeth usually require a distribution such that they cannot solely be supported by the leading ends of the flights. In the valved hollow stem augers considered above, the stem of the auger must stop short of the valve and is thus not available to support detachable teeth.

A powerful spring action must be provided by the spring leaves or applied to the valve members to bias them to a closed position, so as to ensure the avoidance of unwanted opening during boring and assured closing when a sampling tube is withdrawn. This power spring action means that considerable force is required to pass a sampling tube or other tool through the closure, and once so passed, it is gripped quite tightly by the spring leaves or valve members. One reason for using a hollow stem auger is to permit tests of the ground being bored by for example determining its resistance to rotation or penetration of test implements, and the gripping action of the spring leaves or other valve members interferes with such tests and prevents the obtaining of meaningful results. The present invention is directed to overcoming these problems.

SUMMARY OF THE INVENTION

In one aspect of the invention, an auger as described in U.S. Pat. No. 3,095,051 or Canadian Pat. No. 711,139 is improved by taking the auger flights at the leading end of a hollow stem auger bit to a ring coaxial with the bit and beyond the outer ends of the spring leaves or other valve members, the ring carrying a plurality of detachable cutting teeth distributed around its periphery. This results in an auger bit in the form of a rigid cage, the valve members being protected by the cage. In another aspect of the invention, the lowermost of a string of rods utilized for raising and lowering and actuating test implements through a hollow stem auger, with a valve at the lower end of the tube spring biased to a normally closed position, carries an external concentric sleeve capable of passage at least partially through the valve and means releasably connecting the sleeve to said rod whereby the latter may be lowered either conjointly with or independently of said sleeve. The string of rods may thus be used to pass the sleeve partially through the valve so as to hold the latter open, whereupon the sleeve may be released from the lowermost rod so that the rods may be used to lower an implement into the soil beneath the auger. Preferably the releasable connection is a key and keyway type coupling which may be released and engaged by simple rotation of the string of rods relative to the sleeve.

Other features of the invention will be apparent from the following description of a preferred embodiment with reference to the accompany drawings.

SHORT DESCRIPTION OF THE DRAWINGS

DESCRIPTION OF THE PREFERRED EMBODIMENT

Figure 3:
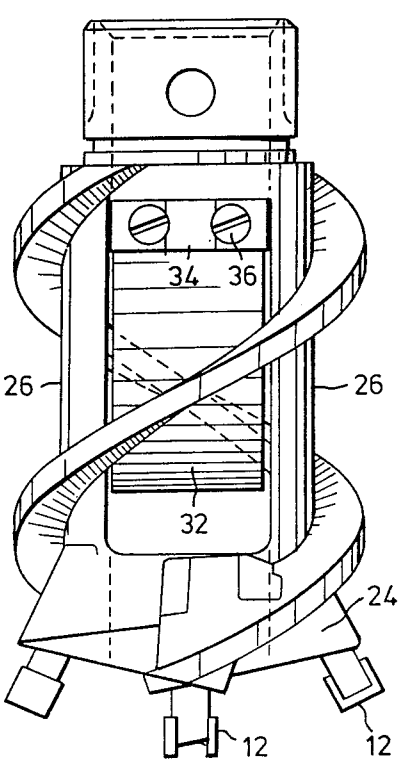
FIGS. 2 and 3 are different side elevations of the auger bit.
Figure 2:
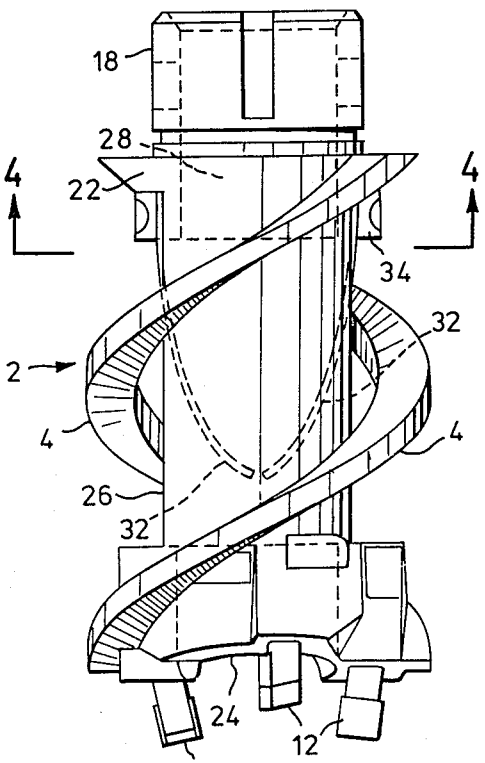

Referring to FIGS. 1–5, an auger bit 2 has helical flights 4, and is supported by tubular member 6 having external flights 8, the flights serving to lift spoil 10 loosened by teeth 12 up the bore 14 formed by the auger in ground 16 being bored as the bit 2 is rotated. The bit 2 is coupled to the member 6 by a coupling sleeve 18 secured by locking pins so that the bit rotates with sleeve. In order to obtain a core sample of the soil beneath the auger, a sample tube 20 may be passed down the tube formed by the member 6 and the bit 2, driven into the soil and withdrawn so as to extract the desired sample. It will be understood that both the member 6 and the tube 20 may be upwardly extended respectively by as many tubes and rods (not shown) as may be necessitated by the depth of the bore hole.

The bit 2 has an upper ring 22 integral with the coupling 18 and a lower ring 24 spaced below and concentric with the upper ring and the member 6. Two spaced plane parallel side walls 26 connect the rings internally of the flights 4 so as to provide a rigid cage structure with concentric circular openings 28, 30 formed by rings at its upper and lower ends so as to provide sufficient room internally to accommodate flexure of two spring leaves 32 within the cage structure as the tube 20 is thrust between them. The spring leaves 32 are anchored to the upper ring 22 by anchor blocks 34 and screws 36, and their operation is similar to that described in U.S. Pat. No. 3,095,051. The valve formed by the spring leaves 32 could also be replaced if desired by the valve arrangement shown in Canadian Pat. No. 711,139, in which rigid valve members are spring urged to a closed position. As compared to the bit structure of those patents, however, that of the present invention is protected by the cage structure from accidental damage for example by rocks in soil being bored. With the prior art arrangements these could become engaged between the lower ends of the flights and exert considerable forces on the latter, as well as possibly damaging the leaves 32. In the present arrangement, any such engagement with an obstruction large enough to cause damage is prevented by the ring 24, which also braces the flights and supports the teeth 12. The teeth are held in place by screws (not shown) in outward projection from the ring 24 and can readily be exchanged or replaced as required. Their location need not, and in the example shown does not coincide with the ends of the flights, whose sole function becomes the removal of spoil.

Figure 1:
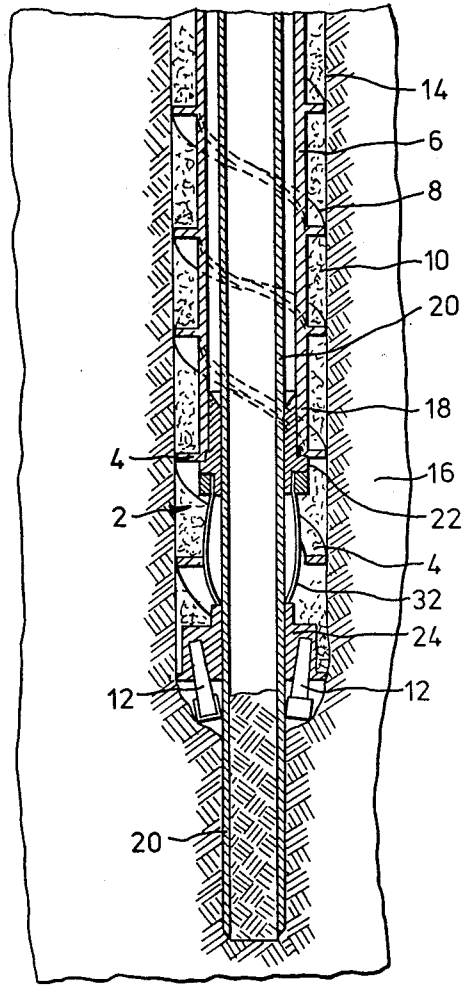
FIG. 1 is a vertical sectional view showing an auger in accordance with the invention, in use.
Figure 4:
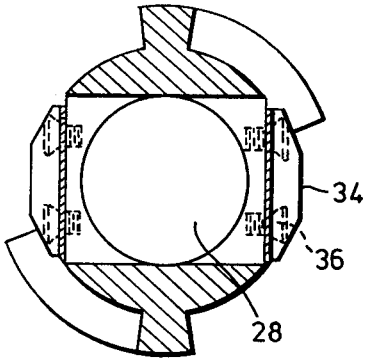
FIG. 4 is a section through the auger bit on the line 4–4 in FIG. 2.
Figure 5:
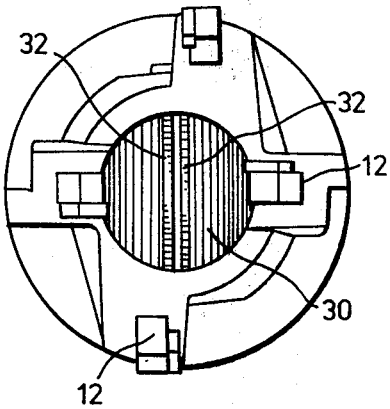
FIG. 5 is a view of the lower end of the auger bit.
Figure 6:
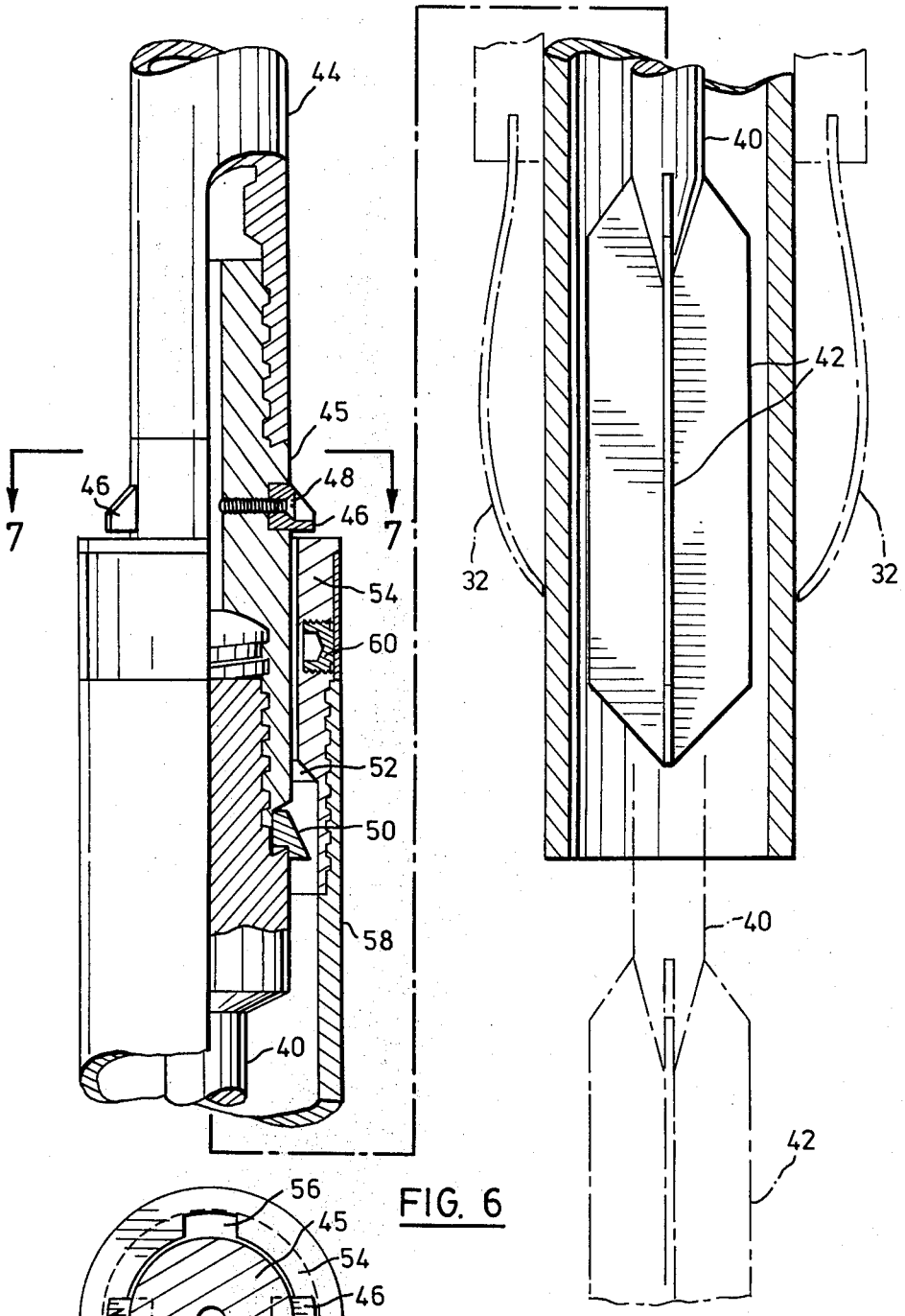
FIG. 6 is a part elevational, part section view of the lower end of a string of rods used to lower and actuate a testing implement through the auger.
Figure 7:
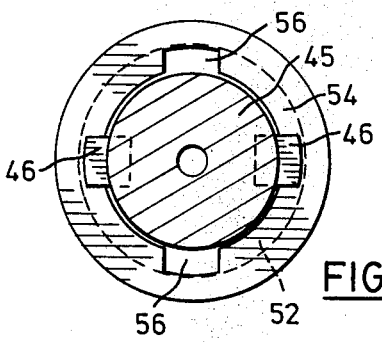
FIG. 7 is a transverse section on the line 6—6 in FIG. 6.

As will be readily apparent from FIG. 1, the spring leaves 32 exert a firm grip on the tube 20 when it is inserted between them. This grip is in some instances undesirable, particularly when implements other than coring tubes are employed to carry out tests on the ground being bored. Such tests include vane tests in which an implement with radially extending vanes is rotated in the soil and, the resistance to rotation is measured and penetration tests in which the resistance of the soil to penetration by an implement is measured. Obviously engagement of the leaves 32 with such an implement or its supporting rods will upset the results of the tests being carried out. A manner in which this problem can be overcome is shown in FIGS. 6 and 7.

The test implement shown by way of example in this case is a vane test implement having a shaft 40 and a soil penetrating head formed by radial vanes 42. It is coupled to the bottom of a string of screw-coupled drilling rods 44. The lowermost rod 45 of the string of rods is equipped with at least one and typically two projecting keys 46 secured thereto by screws 48, and may be no more than a short coupling piece as shown. A projecting washer 50 is captive between the shaft 40 and the rod 45 so as to be engageable with a shoulder 52 on a collar 54 which normally surrounds the rod 45 beneath the keys 46. The collar 54 is formed internally with keyways 56 spaced similarly to the keys 46 so that when the rod 45 and the collar are correctly relatively oriented, the keys can pass through the keyways in the collar so as to permit the rods 44 and 45 to move downwardly relative to the collar until the keys leave the lower end of the keyways. The collar 54 supports a sleeve 58 which surrounds the implement and may either be screwed onto the collar as shown, or, if of small wall thickness, anchored thereto by set-screws 60.

In use, the test implement is lowered down the stem of the auger by means of the rods 44 and 45, with the collar 54 resting on the washer 50 so as to support the sleeve 58. When the bottom of the sleeve reaches the spring leaves 32, further lowering of the rods causes the key 46 to engage the top of the collar 54 and thus to force the sleeve between the leaves 32. When the sleeve has moved partly through the valves formed by the leaves so as to hold the latter apart, the rods 44 and 45 are rotated until the keys 46 drop into and through the keyways 56, whereafter the implement may be lowered further and manipulated as desired by means of the rods without interference from the spring leaves 32. When the rods are withdrawn from the auger stem, the shoulder 52 on the collar is engaged by the keys 46 or the washer 50 and the sleeve 58 is also withdrawn.

It will be appreciated that the means used for releasably coupling the sleeve to the string of rods or the test implement could be different from those described. For example remotely controlled means could be provided for withdrawing the keys 46 into the rod 45 to release the collar, but an arrangement using complementary keys and keyways is simple and can be actuated by simple rotation of the string of rods.

What I claim is:

1. An auger bit for earth boring with a hollow stem auger, said bit having a cage structure formed by spaced concentric upper and lower rings, said upper ring forming a coupling to the remainder of the auger and said lower ring having a plurality of outward projections, side members extending parallel to the axis of the bit directly between said upper and lower rings radially outward of the inner diameters of the rings so as to define therebetween a cavity having spaced plane parallel side walls, and flight members extending helically between said rings externally of both said side members and said rings, cutting teeth releasably anchored in said outward projections from said lower ring, and a pair of valve members extending from said upper ring within said cage structure, said valve members being spring urged to assume a cusp-like formation in which they co-act with the side walls to close the central orifice of said upper ring and being displaceable between said side walls to permit passage of a cylindrical member through and between the orifices in said upper and lower rings.

2. A hollow stem auger for earth boring including a bit having a cage structure formed by spaced concentric upper and lower rings, said upper ring forming a coupling to the remainder of the auger and said lower ring having a plurality of outward projections, side members extending parallel to the axis of the bit directly between said upper and lower rings radially outward of the inner diameters of the rings so as to define therebetween a cavity having spaced plane parallel side walls, and flight members extending helically said rings externally of both said side members and said rings, cutting teeth releasably anchored in said outward projections from said lower ring, a pair of valve members extending from said upper ring within said cage structure, said valve members being spring urged to assume a cusp-like formation in which they co-act with the side walls to close the central orifice of said upper ring, and a cylindrical member passable through said auger stem and through said bit between the orifices in the upper and lower rings so as to displace said valve members between said side walls.

3. An auger as claimed in claim 2, wherein the cylindrical member is a coring tube.

4. An auger as claimed in claim 2, wherein the cylindrical member comprises a cylindrical sleeve, a test implement housed within the sleeve and supported by a string of rods extending down the stem of the auger, and means releasably coupling the sleeve to the test implement and its supporting rods whereby the sleeve whilst so coupled is passable through said bit to displace said valve members, and when uncoupled permits actuation of said implement independently of said sleeve.

5. An auger as claimed in claim 4, wherein the releasable coupling means comprises a coupling rod connecting the test implement to the remainder of the string of rods and a collar supporting the sleeve and normally surrounding the coupling rod, said coupling rod and collar having complementary keys and keyways to permit or restrict relative axial movement of the sleeve and the implement according to their relative angular positions.

6. In an earth boring auger having a hollow stem closed at its lower end by spring urged valve members, coupling means for attaching a test implement to a string of drill rods lowered down the auger stem, comprising a coupling rod, a collar normally surrounding the coupling rod, a cylindrical sleeve depending from the collar so as to surround an implement when coupled to the coupling rod, and means releasably coupling the collar to the coupling rod so that when uncoupled said rod may move axially into the sleeve.

7. Coupling means as claimed in claim 6, wherein the coupling rod and collar have complementary keys and keyways, such that the latter may be uncoupled from the rod by rotating the rod so that the key may move through the keyways.

* * * * *